United States Patent [19]

Sato

[11] 4,147,888

[45] Apr. 3, 1979

[54] ELECTRIC HEATING ELEMENT FOR ELECTRIC RESISTANCE FURNACES

[76] Inventor: Seiki Sato, 5-984 Negishi, Asaka-shi, Saitama-ken, Japan

[21] Appl. No.: 817,425

[22] Filed: Jul. 20, 1977

[51] Int. Cl.[2] ..... H05B 3/00

[52] U.S. Cl. ..... 13/22; 13/25; 338/283; 338/284; 338/295; 219/552

[58] Field of Search ..... 13/25, 22; 338/283, 338/284, 287, 288, 289, 295; 219/552, 553, 388 R, 390

[56] References Cited

U.S. PATENT DOCUMENTS

| | | | |
|---|---|---|---|
| 1,432,442 | 10/1922 | Collins | 13/25 |
| 1,864,334 | 6/1932 | Baily | 13/25 X |
| 1,901,499 | 3/1933 | Fahrenwald | 13/25 |
| 1,928,142 | 9/1933 | Trent et al. | 13/25 X |

*Primary Examiner*—R. N. Envall, Jr.
*Attorney, Agent, or Firm*—Robert E. Burns; Emmanuel J. Lobato; Bruce L. Adams

[57] ABSTRACT

An electric heating element for electric resistance furnace comprises a plurality of heater frames which consist of conductive strip material having a sectional shape selected from leg angle-section, channel-section, lip-section, T-section, U-section, V-section, I-section, H-section, Z-section, and W-section and having electric resistance. The heater frames have a configuration coinciding with a sectional shape of an inner wall of a heating chamber of the furnace, and are made and arranged to have an opening portion. Conductive connecting rods are adapted to connect both ends of each of said heater frames to alternatively adjacent ends of adjacent heater frames so as to constitute a single wire resistance body of said heater frames, and a conductive rod connected with one end of said wire resistance body is arranged to pass through said opening portion of said heater frames and facing a power source terminal together with the other end of said wire resistance body. The electric heating element is arranged at a position in a heating chamber without inserting ceramic supports and does not deform at high temperature without good reason.

4 Claims, 13 Drawing Figures

ELECTRIC HEATING ELEMENT FOR ELECTRIC RESISTANCE FURNACES

BACKGROUND OF THE INVENTION

1. Field of the Invention:

The present invention relates to an electric element for electric resistance furnaces and more particularly to an electric heating element for electric heating furnaces which is used in various heat treatments, such as melting of metal, glazing of ceramic wares or the like.

2. Description of the Prior Art:

An electric resistance furnace has been generally widely used in heat treatment, melting of various samples, glazing of ceramic wares, and particularly in precise or continuous treatment processes because the furnace using an electric heater as its heat source can obtain respectively high temperature and temperature control and handling is easy.

In the conventional electric resistance furnace, as shown in FIG. 1, a heating chamber is enclosed by walls having a layered structure from the exterior as follows: a metal board, adiabatic layers for keeping warm, and ceramic bricks on which channel shaped heater receiving portions are provided. A heater element of coil resistance wire having circular shape in section or corrugated resistance wire having rectangular shape in section is received and maintained in the heat receiving portions to prevent deformation by heat of the resistance wire at high temperature.

However, in the heater element so supported, the greater part (about $\frac{1}{2}$–$\frac{1}{3}$) of the heat generating surface is covered by the ceramic bricks and therefore heat from the heater forms an atmosphere of high temperature in the heating chamber after rising the temperature of the ceramic bricks at the heater receiving portions. Because of this, the heat capacity of the entire furnace is remarkably large thereby to necessitate useless treating time and electric power dissipation (electric heats). Accordingly, such a furnace cannot function to rapidly rise or lower the temperature therein. It is difficult to form heater receiving portions having complicated configuration on the fragile ceramic bricks and the manufacturing cost of such a furnace is high. Further, owing to provision of the ceramic bricks, there are defects in that the furnace is heavy, difficult to carry and install and large in size. In addition, because the ceramic bricks are high in moisture absorption, there are defects in that oxygen gas is generated by contained moisture to be separated at high temperature so as to oxidize the samples and in that leak loss occur. Particularly, because dry burning is necessitated at high moisture conditions, it has been greatly desired to keep the shape of the heating element stable under the high temperature without using the ceramic bricks for keeping shape stable.

As shown in FIG. 2, there has been provided a resistance wire having circular shape in section coiled in a spiral cylinder along a heating chamber, and ceramic supports are inserted between spiral pitches to keep shape of the resistance wire at an atmosphere of high temperature. However, since the thickness of such resistance wire is limited with respect to the resistance value and may be deformed under the influence of heat if it is not cylindrical, there is a defect in that the furnace used is limited to the cylindrical shape. Also, because the spaces between pitches are easy to vary, and since a number of ceramic supports must be used, there are the same defects as that of the furnace shown in FIG. 1, for example, impossible rapid rising or lowering of temperature, expensive cost of manufacture, generation of oxygen gas or the like. Further, removing and mounting of the resistance wire in case of a defect, such as disconnection, deterioration or the like, destroys the ceramic bricks, and also the resistance wire shown in FIG. 2 must embed a lead wire passing through a power source terminal into an inner wall (usually ceramics) of the heating chamber. Accordingly, change of the electric heating element is not easy in the structures mentioned above.

As described above, the conventional heater wire having circular shape in section necessitates ceramic supports in order to keep the shape of the electric heating element in the atmosphere of high temperature and therefore it has been impossible to prevent oxygen gas being generated in the heating chamber in order to heat treat without oxidation the sample because an electric heating element shape keeping material which is suitable does not exist besides the known ceramics.

Further, it has not been proposed that the electric heating element be of a cartridge type to be capable of easily being exchanged.

Although it has been proposed to use a surface resistance element of mesh type as an electric heating element, because it is difficult to adjust temperature, such a surface resistance element is used only in a heat treatment furnace operated at lower temperature and can not be used for a high temperature furnace. Therefore, it is desirable to maintain a wire resistance body at an individual condition under a high temperature without using the shape keeping material.

BRIEF SUMMARY OF THE INVENTION

In order to eliminate the above various defects with respect to the conventional heating element, it is an object of the present invention to provide an electric heating element for an electric resistance furnace in which a wire resistance is used to obtain an atmosphere of high temperature and electric heating elements are not required to be protected with ceramics thereby to minimize heat capacity of a heating chamber, to be capable of rapidly rising or lowering temperature, to shorten treatment time, and to be small in size and light in weight.

It is another object of the present invention to provide an electric heating element for electric resistance furnace in which a sample is not oxidized by reducing generation of oxygen gas in a heating chamber.

It is a further object of the present invention to provide an electric heating element which constitutes a unit to be capable of simply being exchanged.

It is a still a further object of the present invention to provide an electric heating element which can obtain an atmosphere of higher temperature by reducing surface load and which has a long life.

BRIEF DESCRIPTION OF THE DRAWINGS

In order that the invention may be more fully understood, preferred embodiments and supplementary features will be now described with reference to the accompanying drawings, in which.

Figure 4:
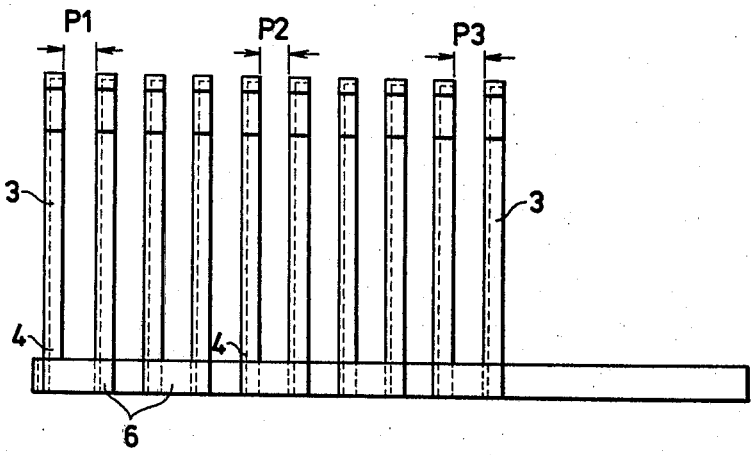
FIG. 4 is an explanatory view showing one embodiment of the electric heating element, FIG. 4*a* being a side view, FIG. 4*b* a bottom view, FIG. 4*c* a front view and FIG. 4*d* an explanatory view of a bending portion.
Figure 4:
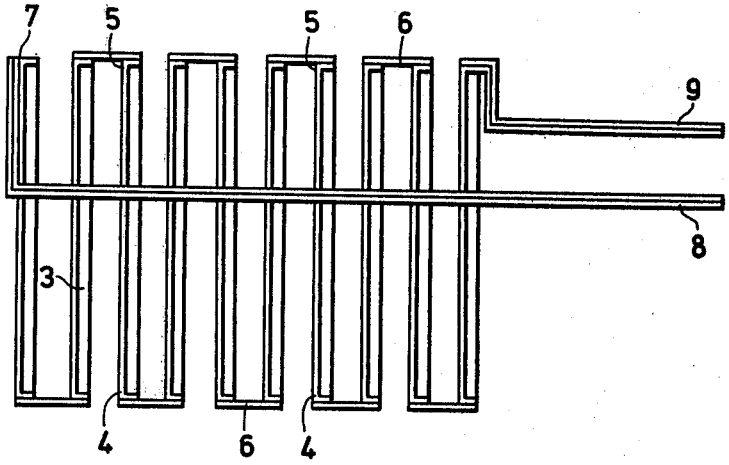
Figure 4:
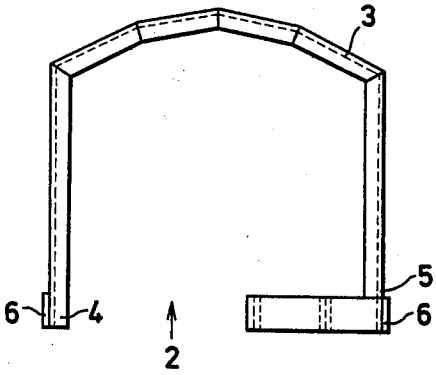
Figure 4:
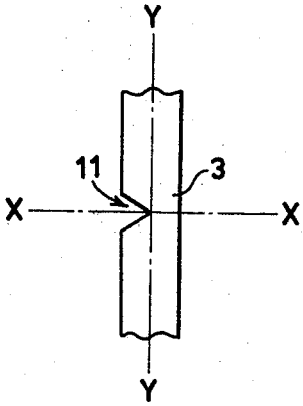
Figure 5:
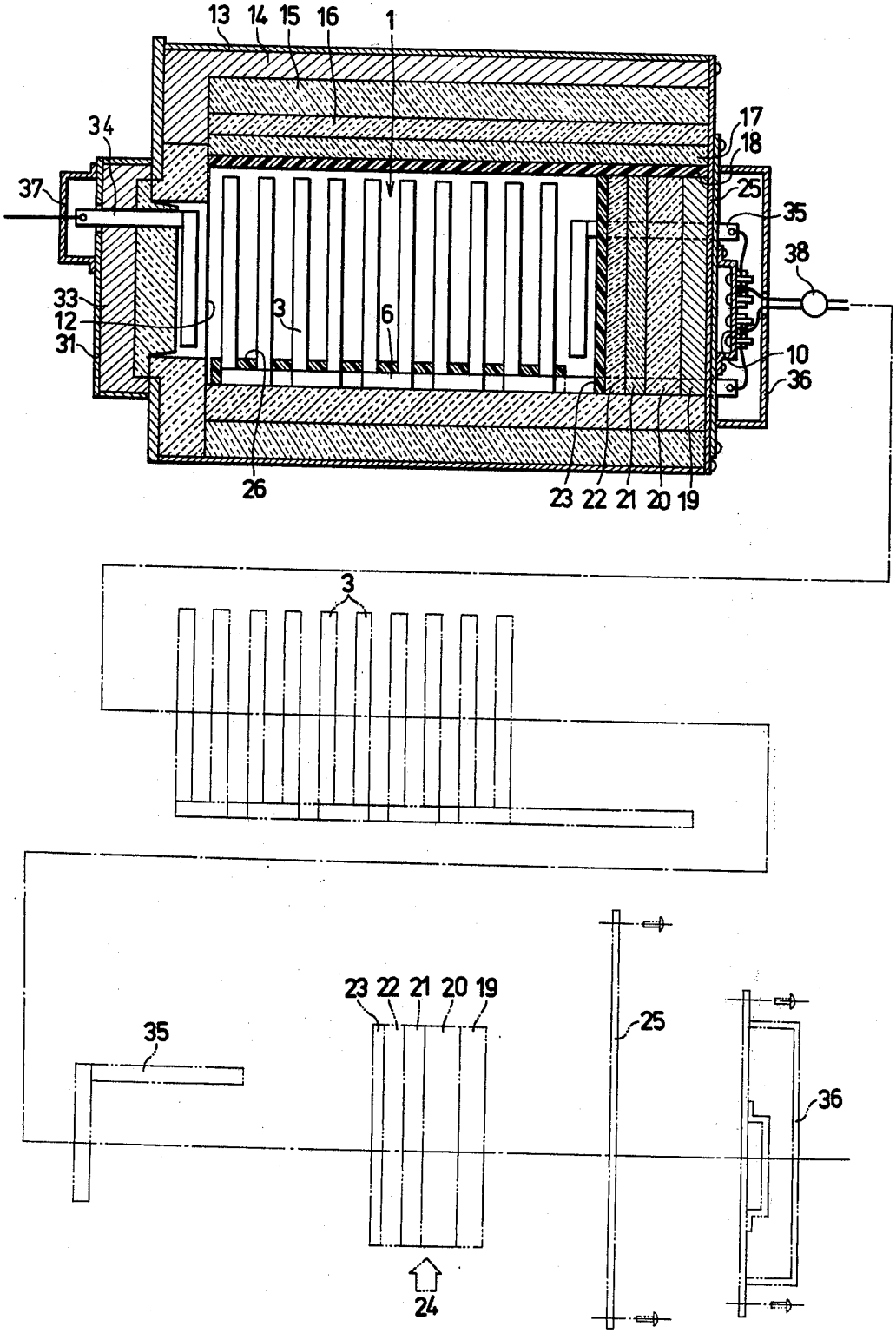
FIGS. 5 and 6 show one embodiment of electric resistance furnace incorporating the electric heating element, FIG. 5 being a longitudinal sectional view and FIG. 6 being a front view partially cut.
Figure 6:
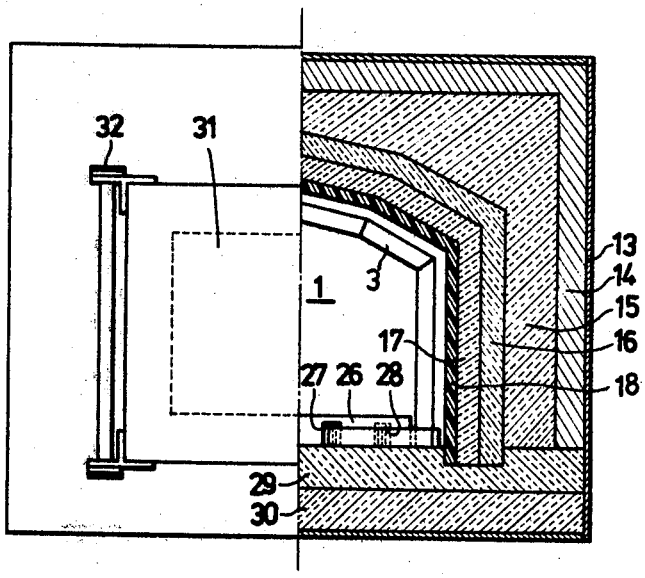
Figure 7A:
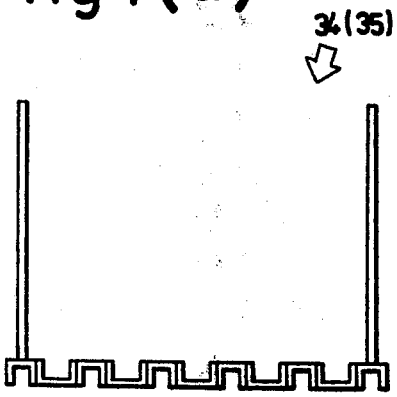
FIG. 7 shows an electric heating element used in a front plate and back plate of the electric resistance furnace shown in FIG. 5 but these do not relate to the present invention, FIG. 7*a* being a front view and FIG. 7*b* being a plan view.
Figure 7B:
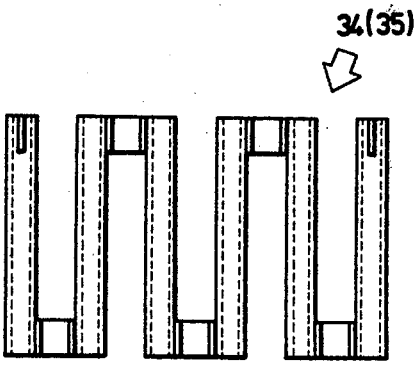

DETAILED DESCRIPTION OF THE INVENTION:

Referring to FIG. 4, there is shown an electric heating element forming heater frames which is made by conductive strip material having electric resistance, for example, kanthal alloy (iron-aluminum-chromium alloy), nichrome alloy, iron-chromium alloy, or platinum alloy. The electric heating element is formed from a strip piece of the above material shaped as any of leg angle section, channel section, lip section, T-section, U-section, V-section, I-section, H-section, Z-section and W-section by roller process if possible, usually, bending process, welding process or connecting means of rivet, bolt, press fitting or the like. A plurality of heater frames 3 have a shape to coincide with a sectional configuration of a heating chamber 1 and have an opening portion 2 formed by cutting a portion of the above shape. The heater frames may be made to the above shape by bending, welding, rivet connection, press fitting connection, bolt connection, etc. The plurality of heater frames 3 are arranged according to the shape of the heating chamber 1 and both ends 4 and 5 of each of the heater frames 3 are alternatively connected to both ends 4 and 5 of adjacent heater frames by conductive connecting rod 6 of kanthal alloy, nichrome alloy or the like so as to constitute a single resistance body. The connection may be made by welding, rivet, bolt, press fitting or the like. A conductive rod 8 of heat resistant conductive material is connected to one end 7 of the resistance body and is located at the opening portion 2 of the heater frames 3 so as to face a power terminal 10 together with another end 9 of the above resistance body.

Referring to FIGS. 4 to 7, there is shown one embodiment of an electric heating element according to the present invention. A strip material of kanthal wire (iron-aluminum-chromium alloy) includes a cut portion 11 at a position (x — x) to be bent so as to be formed L-shape in section as in FIG. 4 and is bent at the position (x — x) after bending generally at right angles in a longitudinal direction of a position (Y — Y) to be bent. The cut portion 11 is usually welded by the same material as the strip material used. The heater frames 3 made from the electric heating element as mentioned above are formed in arch shape having an opening portion 2 to coincide with the shape of a heating chamber 1 (FIG. 6) and are arranged at suitable numbers (10 pieces in FIG. 4). The heater frames 3 are provided with a conductive connecting rod 7 and a conductive rod 8. The heater frame shown is selected at 10 pieces according to the resistance value of kanthal wire used and to the design temperature of the furnace . Spaces $P_1$, $P_2$, and $P_3$ between the heater frames 3 are minimum at $P_1$ near a sample port 12, maximum at center portion $P_2$, and intermediate at a back plate portion $P_3$ so as to make an atmosphere in the furnace uniform. Such pitches $P_1$, $P_2$ and $P_3$ may be simply adjusted by selecting the length of the conductive connecting rod 6. Further, the conductive rod 8 is made by piling two kanthal wires to minimize calorific value and resistance value of the conductive rod 8 may be suitably selected according to the furnace to be used.

A cylindrical layer is constituted from a metal plate 13, rock wool 14 (adiabatic material), adiabatic bricks 15, kao-wool 16 and 17 (alumina fiber) and ceramics 18. Fitted to the cylindrical layer is a back adiabatic layer 24 consisting of rock wool 19, adiabatic bricks 20, kao-wool 21 and 33, and ceramics 23. A back plate 25 of metal is fixed by bolts (not shown) as usual. A floor board 26 of the furnace is provided with slits 27 and 28 which are adapted to fit the conductive rod 8 of the heater frames 3 and the other end 9 of the wire resistance body. An adiabatic brick 29 forms a bottom wall together with a rock wool layer 30. Reference numerals shows a door at 31, a hinge for the door at 32 and a kao-wool layer at 33. Further, six pieces of electric heating elements 34 are provided on an inner wall of the door 31 and four pieces of electric heating elements 35 are provided on the back adiabatic layer 24, these heating elements being formed by strip material of channel section as in FIG. 7. Switch boxes 36 and 37 are connected by flexible cable (not shown) and which connects power source at a terminal 10 in the order of the heater frames 3, the back electric heating elements 35 and the door electric heating elements 34.

Therefore, when the power source is turned on, the sample on the floor board 26 of the furnace is heat treated by generation of heat from the heater frames 3, the back heating elements 35 and the front heating elements 34. The heater frames 3 can be easy to remove by being disconnected from the switch box 36 and by removing the back adiabatic layer 24, as shown by dots and line in FIG. 5.

Figure 8:
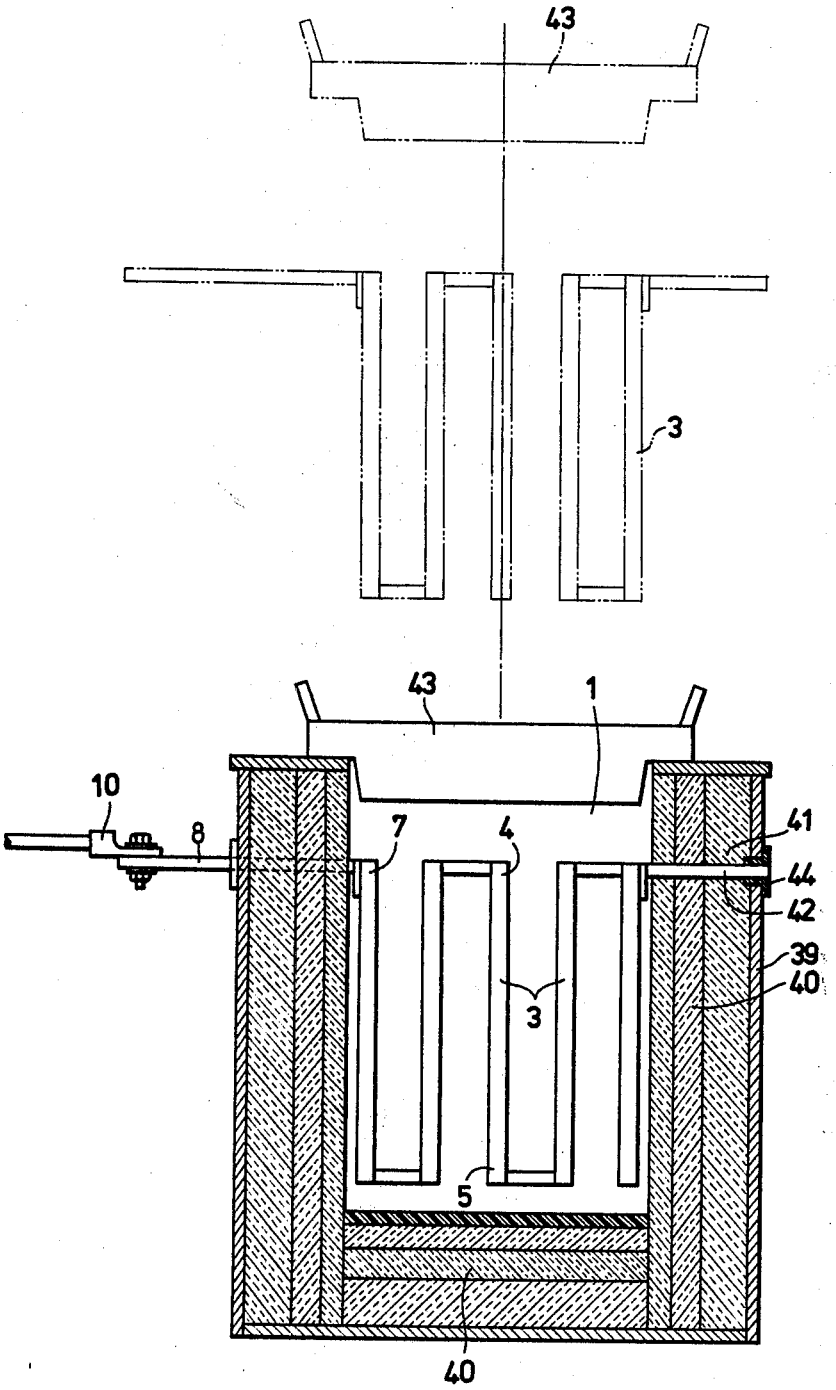
FIGS. 8 and 9 show another embodiment according to the invention, FIG. 8 being a longitudinal sectional view and FIG. 9 being a transverse sectional view.
Figure 9:
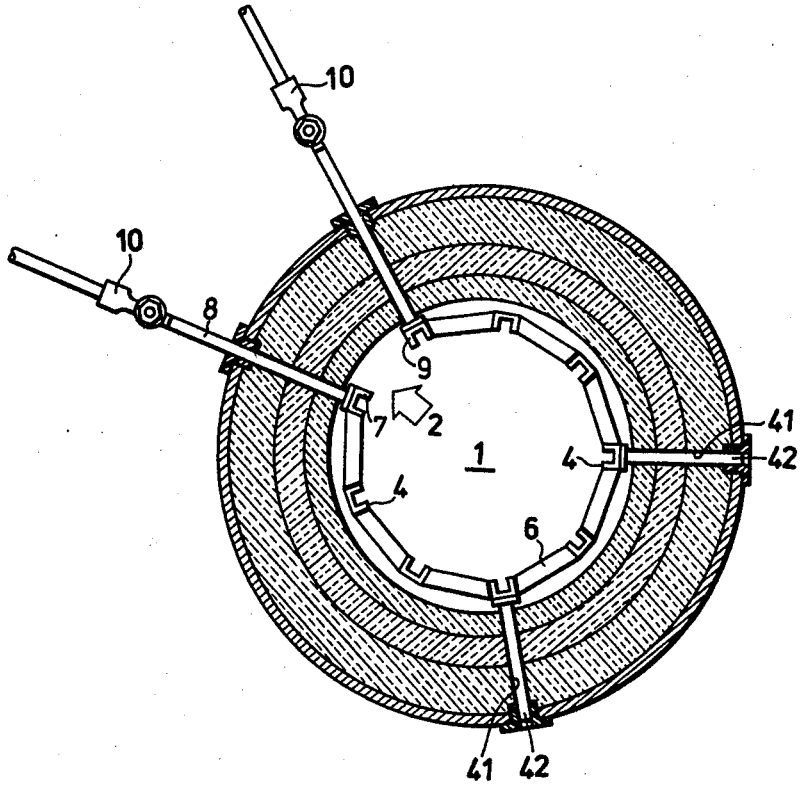

Referring to FIGS. 8 and 9, there are shown electric heating elements which are made from strip material of platinum and which are bent in channel shape in section. These electric heating elements (eight pieces in FIG. 9) are arranged in ring form leaving an opening portion 2. Upper and lower ends 4 and 5 of the electric heating elements are connected at an alternatively adjacent end by a conductive connecting rod 6 so as to constitute a single wire resistance body. A conductive rod 8 connected to one end 7 of the wire resistance body faces a power source terminal 10 together with the other end 9 of the wire resistance body. Reference numerals indicate respectively a power source at 38, a metal outer cover at 39, and an adiabatic wall consisting of a triple cylinder of kao-wool (alumina fiber). Slits 41 are provided at suitable positions (four positions in FIG. 9). Into the slits are inserted a fixing rod 42 connected to the heater frames 3 and the conductive rod 8, respectively, so as to rigidly support the heater frames 3 in the heating chamber 1. In the slits 41 is embedded kao-wool after inserting the fixing rod 42. Reference numerals indicate an open and closed cover at 43 and a ceramic collar at 44.

Therefore, when the power source is turned on, the wire resistance body constituted by the heater frames 3 is conductive and because it is electrically heated an atmosphere of high temperature is generated in the heating chamber 1. Exchange of the heater frame 3 can be easy carried out by removing the open and closed cover 43 and the adiabatic material embedded in the slits 41, as shown by dots and line in FIG. 8.

In the furnace shown, since ceramics are not entirely used in the heating chamber 1 and heat insulation and heat a heat barrier can be made using only an adiabatic material such as kao-wool (alumina fiber) which is only slightly hygroscopic, oxidation of the sample does not occur because of a lack of oxygen gas generated in the atmosphere of high temperature.

Figure 1:
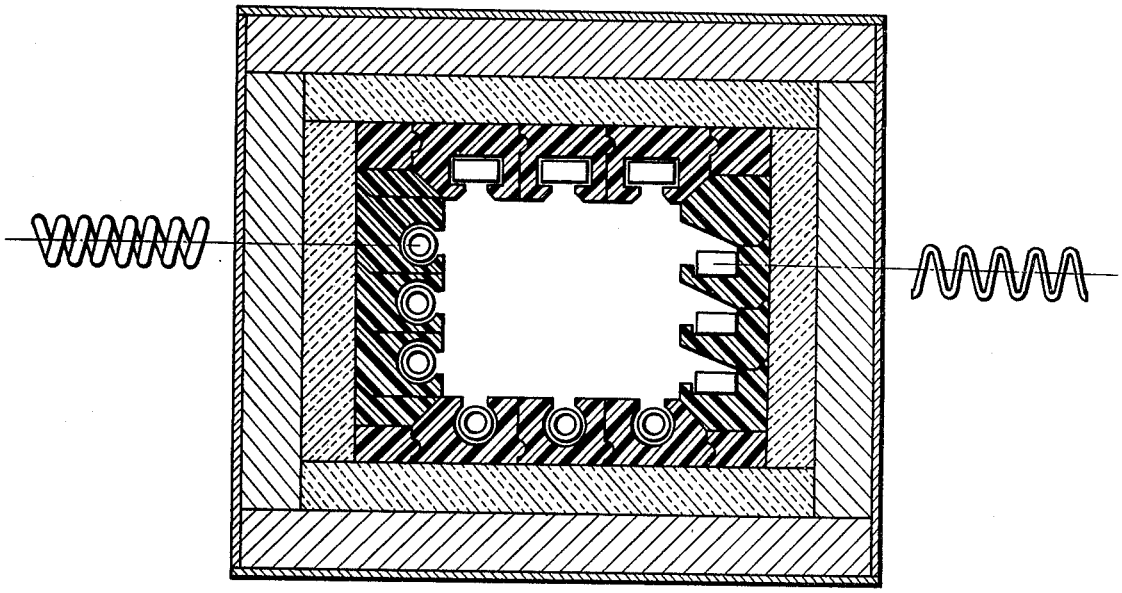
fig 1 (PRIOR ART)
FIG. 1 is a longitudinal sectional view showing the conventional electric resistance furnace, an electric heating element being shown to be a coil resistance wire and a corrugated resistance wire.
Figure 2:
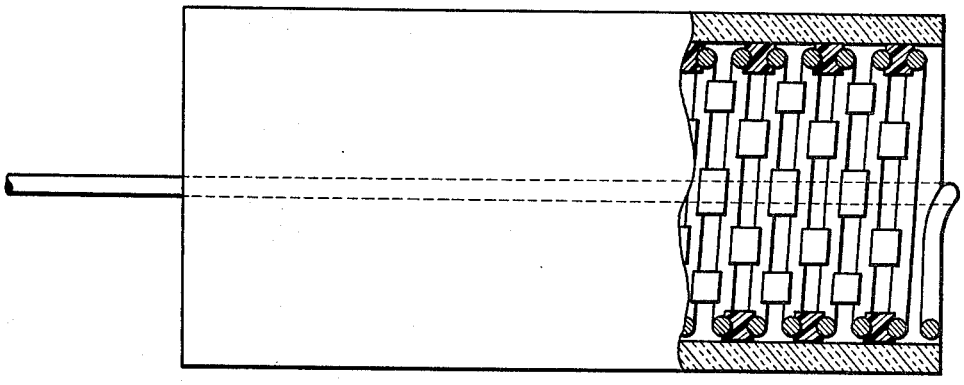
fig 2 (PRIOR ART)
FIG. 2 is a front view cut partially and showing the conventional electric resistance furnace differing from FIG. 1.
Figure 3:
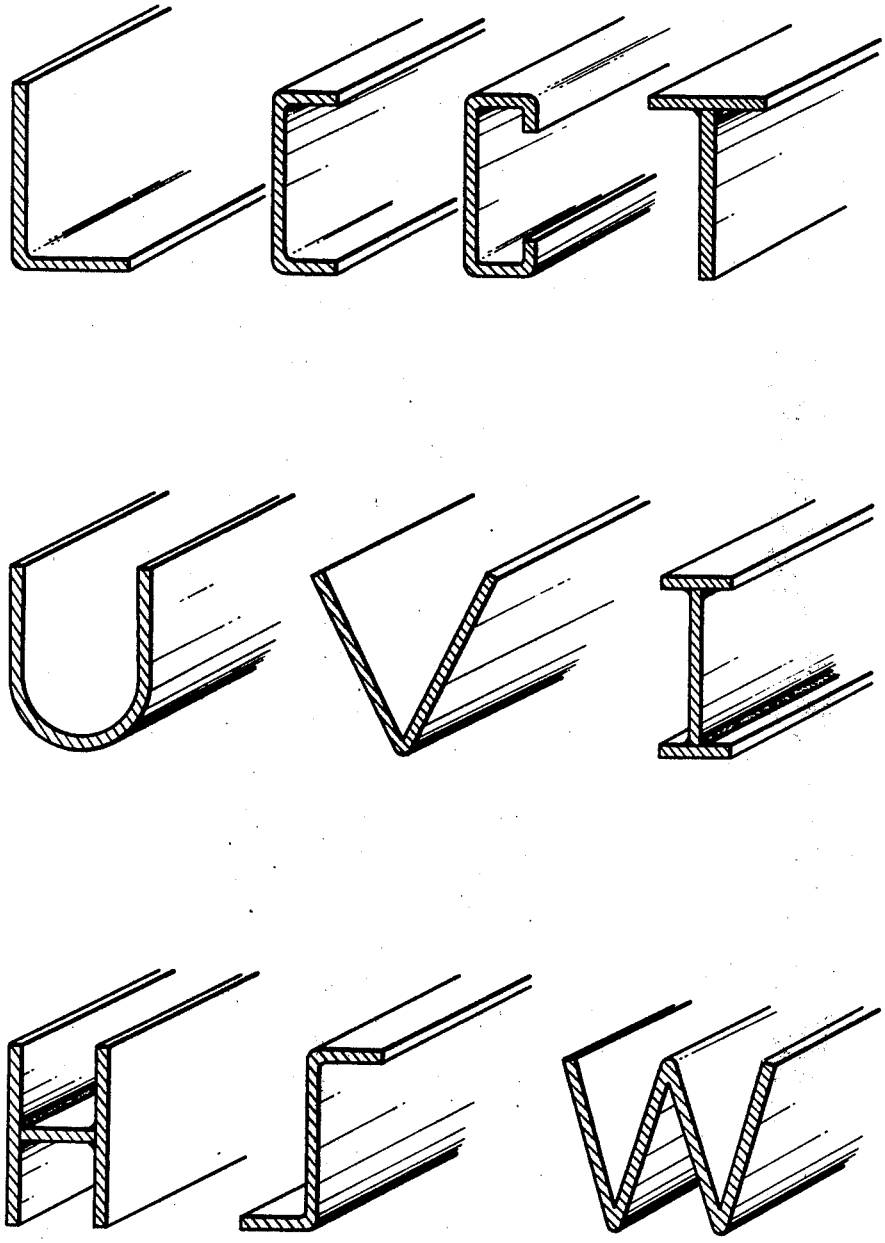
FIG. 3 is a sectional perspective view showing various sections of an electric heating element according to the present invention.

As understood from the above description, according to the present invention, the electric heating element comprises a plurality of heater frames which consist of conductive strip material having a sectional shape as in FIG. 3 and having electric resistance, and which have a configuration coinciding with a sectional shape of an inner wall of the heating chamber 1 and which are made and arranged to have an opening portion 2, conductive connecting rods 6 adapted to connect both ends of each of the heater frames 3 to alternatively adjacent ends 4 and 5 so as to constitute a single wire resistance body with the heater frames 3, a conductive rod 8 arranged at the opening portion 2 of the heater frames 3 and facing the power source terminal together with the other end 9 of the wire resistance body. The heater frames having a sectional shape as in FIG. 3 are remarkably large in sectional coefficient as compared with the conventional heater wire having circular or rectangular sectional shape. In addition, because each of the heater frames is connected at its both ends 4 and 5 by the conductive connecting rod 6 generally intersecting at right angles thereto, there has no defect wherein spaces between the heater frames are easy to deform as in the case of a heater element having a spiral shape. Therefore, with the heater frames of the invention, a solid wire resistance body is formed, which is not easily deformed by heat or external force and which does not necessitate supporting members of ceramic or the like.

Therefore, the heater frames 3 according to the invention can be made in various shapes without being limited only in cylindrical shape and can adapted for use in various electric heating furnaces. Further, because heat of the heater frames can rapidly produce an atmosphere of high temperature in the interior of the heating chamber 1 by convection and radiation, the temperature of the heating chamber 1 is capable of rapidly rising or lowering whereby heat treating time is reduced and the effect is remarkable in continuous treatment. Furthermore, with such heater frames, power consumed in use is small and since response of the temperature is fast, temperature control can be positively carried out.

In addition, though in the conventional heater frames the ceramic bricks used as a supporting material have been a a big factor contributing to the large size and heavy weight of the conventional furnace, since the heater frames of the invention do not necessitate the conventional ceramic brick structure a furnace which is light in weight and which is small in size can be realized and manufactured, and cost can be remarkably reduced as compared with the conventional heater frames which require a heater receiving portion having complicated shape in the fragile bricks.

Further, though hygroscopic ceramics used as a heater supporting member generate oxygen gas and cause leak loss, because the heater frames of the invention are capable of setting at individual condition in the heating chamber 1, the generation of oxygen gas from the heater frames 3 and the heating chamber 1 is prevented by adopting adiabatic materials other than ceramics for example, kao-wool on the inner wall of the heating chamber 1. Therefore, oxidation of the sample in heat treatment and leak loss by moisture absorption of the supporting member can be prevented.

Also, because the heater frames 3 of the invention form a single wire resistance body and have an opening portion 2 which is adapted to connect with a conductive rod 8 which is not in danger of leaking heat and which can be made as a unit, the conductive rod 8 need not be covered and embedded within the furnace wall as in the prior art, and exchange of the heater frames 3 is remarkably easy.

Furthermore, since the heater frames 3 of the invention can reduce its surface load as compared with the conventional heater frames having circular or rectangular shape in section, the furnace can form the atmosphere of high temperature and can lengthen life of the heater frames whereby the electric heating furnace can be made larger. Since spaces between the heater frames 3 are easily changed changing the length of the conductive connecting rod 6, adjustment in manufacture carried out to keep temperature in the heating chamber 1 uniform is easy. As understood from the above description, the present invention provides a very useful heating element for electric heating furnace.

While the described embodiments present the preferred forms of the present invention, it is to be understood that modifications will occur to those skilled in that art without departing from the spirit of the invention. The scope of the invention is therefore to be determined solely by the appended claims.

What is claimed is:

1. An electric heating element for an electric heating furnace, comprising:

a plurality of parallel and regularly spaced heater frames each comprised of stright segments of conductive electric resistance heater strip stock having a polygonal cross section, each heater frame having a pair of ends, and said plurality of heater frames being relatively adjacently positioned to define a space heated by said plurality of heater frames when electrical current flows therethrough, and said heater frames being positioned to define the heating element as having an open portion;

straight conductive connecting rods respectively connecting alternate end pairs of successive ones of said heater frames to define a series electrically conductive path through said plurality of heater frames and said straight conductive connecting rods, said straight conductive connecting rods being positioned perpendicular to the respective heater frames to which they are connected, and said heater frames and said straight conductive connecting rods having dimensions sufficient to define a rigid self-supporting heating element sufficiently rigid to maintain its shape during heating in use without additional support structure; and a conductive rod extending from one end of the electric heating element and terminating adjacent another end of the electric heating element for defining a power input terminal pair of the electric heating element.

2. An electric heating element according to claim 1, wherein said heater frames are generally arch-shaped and each has a pair of legs terminating at the respective ends of the heater frame; said plurality of heater frames being positioned parallel with their respective arch shapes opening toward an open bottom of the electric heating element, said plurality of straight conductive connecting rods connecting respective alternate leg end pairs of successive ones of the arch-shaped heater frames, and said conductive rod extending from one end of the electric heating element through the open bottom of the electric heating element to the other end thereof.

3. An electric heating element according to claim 2, wherein said heater frames are spaced non-uniformly for effecting a uniform temperature within the space heated by the electric heating element.

4. An electric heating element according to claim 1, wherein said heater frames are straight segments disposed around a circle and with their respective length dimensions parallel for defining a cylindrical space heated by the electric heating element, a pair of adjacent heater frames being unconnected by straight conductive connecting rods and having a space therebetween, and said conductive rod and a second conductive rod extending from respective ones of said pair of adjacent unconnected heater frames and defining a power input terminal pair.

* * * * *